US012270226B1

(12) United States Patent
Burke et al.

(10) Patent No.: US 12,270,226 B1
(45) Date of Patent: Apr. 8, 2025

(54) COMPOSITE ELEVATED TANK AND METHOD OF CONSTRUCTION

(71) Applicant: Caldwell Tanks, Inc, Louisville, KY (US)

(72) Inventors: Gerald A. Burke, Louisville, KY (US); Timothy Q. Ogle, Liberty, KY (US); Gregg Smith, Bardstown, KY (US); Michael Shaffer, Greenville, IN (US); K.G. Aditya Atluri, Louisville, KY (US); William R. Farmer, Newnan, GA (US); Matthew L. Clark, Ankeny, IA (US); Donald L. Stilger, Corydon, IN (US)

(73) Assignee: Caldwell Tanks, Inc., Louisville, KY (US)

( * ) Notice: Subject to any disclaimer, the term of this patent is extended or adjusted under 35 U.S.C. 154(b) by 68 days.

(21) Appl. No.: 17/892,978

(22) Filed: Aug. 22, 2022

(51) Int. Cl.

| | |
|---|---|
| ***E04H 7/04*** | (2006.01) |
| ***B65D 88/08*** | (2006.01) |
| ***B65D 90/12*** | (2006.01) |
| ***E02D 27/38*** | (2006.01) |
| ***E04H 7/00*** | (2006.01) |
| ***E04H 7/02*** | (2006.01) |
| ***E04H 7/06*** | (2006.01) |

(Continued)

(52) U.S. Cl.
CPC ..... *E04H 7/04* (2013.01); *B65D 88/08* (2013.01); *B65D 90/12* (2013.01); *E02D 27/38* (2013.01); *E04H 7/00* (2013.01); *E04H 7/02* (2013.01); *E04H 7/06* (2013.01); *E04H 7/18* (2013.01); *E04H 12/30* (2013.01)

(58) Field of Classification Search
CPC .. E02D 27/38; E04H 7/00; E04H 7/02; E04H 7/04; E04H 7/06; E04H 7/18; E04H 12/30; B65D 88/08; B65D 90/12
See application file for complete search history.

(56) References Cited

U.S. PATENT DOCUMENTS 2,567,958 A * 9/1951 Mummert ..... E04H 12/30 52/194
2,679,853 A * 6/1954 Bryant ..... E04H 12/30 134/166 R (Continued)

FOREIGN PATENT DOCUMENTS

| | | | | |
|---|---|---|---|---|
| CA | 2339703 A1 * | 9/2001 | ..... | E03B 11/12 |
| CN | 106697625 A * | 5/2017 | | |
| FR | 1493697 A | 9/1967 | | |

OTHER PUBLICATIONS

VSL International; Concrete Storage Structures Use of the VSL Special Construction Methods, 51 pages, dated May 1983.

*Primary Examiner* — Jessie T Fonseca
(74) *Attorney, Agent, or Firm* — Stites & Harbison, PLLC; David W. Nagle, Jr.

(57) ABSTRACT

A composite elevated storage tank for smaller capacities having an improved anchorage connecting the steel tank to the reinforced concrete pedestal. The anchorage includes tank anchor assemblies and an insulator at a top surface of the concrete pedestal, with anchors embedded in the concrete. The steel tank includes a skirt and base plates welded to a bottom cone section of the tank. The skirt, base plates, and tank anchor assemblies enable the steel tank and the reinforced concrete pedestal to be constructed on-site simultaneously.

25 Claims, 16 Drawing Sheets

(51) Int. Cl.
*E04H 7/18* (2006.01)
*E04H 12/30* (2006.01)

(56) References Cited

U.S. PATENT DOCUMENTS

| | | | | | |
|---|---|---|---|---|---|
| 2,683,550 | A * | 7/1954 | Mummert | E04H 12/30 | 220/567 |
| 2,741,268 | A * | 4/1956 | Plunkett | E03B 11/00 | 138/148 |
| 3,073,573 | A * | 1/1963 | Haskins | E04H 7/06 | 60/420 |
| 3,219,224 | A | 11/1965 | Anderson | | |
| 3,235,956 | A | 2/1966 | Heathcote | | |
| 3,300,916 | A | 1/1967 | Pritzker | | |
| 3,805,369 | A | 4/1974 | Harper | | |
| 4,312,167 | A | 1/1982 | Cazaly | | |
| 4,327,531 | A | 5/1982 | Cazaly | | |
| 4,403,460 | A | 9/1983 | Hills | | |
| 4,486,989 | A | 12/1984 | Desrochers | | |
| 4,494,291 | A | 1/1985 | Morrison | | |
| 4,578,921 | A | 4/1986 | Cazaly | | |
| 4,660,336 | A * | 4/1987 | Cazaly | E04H 12/30 | 52/192 |
| 5,029,426 | A | 7/1991 | Larson | | |
| 5,131,201 | A | 7/1992 | Larson | | |
| 6,282,863 | B1 | 9/2001 | Christian | | |
| 6,318,034 | B1 | 11/2001 | Zavitz | | |
| 7,044,072 | B2 | 5/2006 | Converse | | |
| 7,162,844 | B2 | 1/2007 | Morrison | | |
| 7,188,574 | B2 | 3/2007 | Converse | | |
| 7,500,592 | B1 | 3/2009 | Petricio Yaksic | | |
| 8,261,510 | B2 | 9/2012 | Johnson | | |
| 8,820,009 | B2 | 9/2014 | Johnson | | |
| 9,217,255 | B2 | 12/2015 | Mork | | |
| 9,556,626 | B2 | 1/2017 | Mork | | |
| 2013/0031854 | A1 * | 2/2013 | Johnson | E04H 12/30 | 52/192 |
| 2015/0368038 | A1 * | 12/2015 | Oren | B65D 88/022 | 220/601 |
| 2016/0168873 | A1 * | 6/2016 | Neighbors | B65D 88/08 | 52/194 |

* cited by examiner

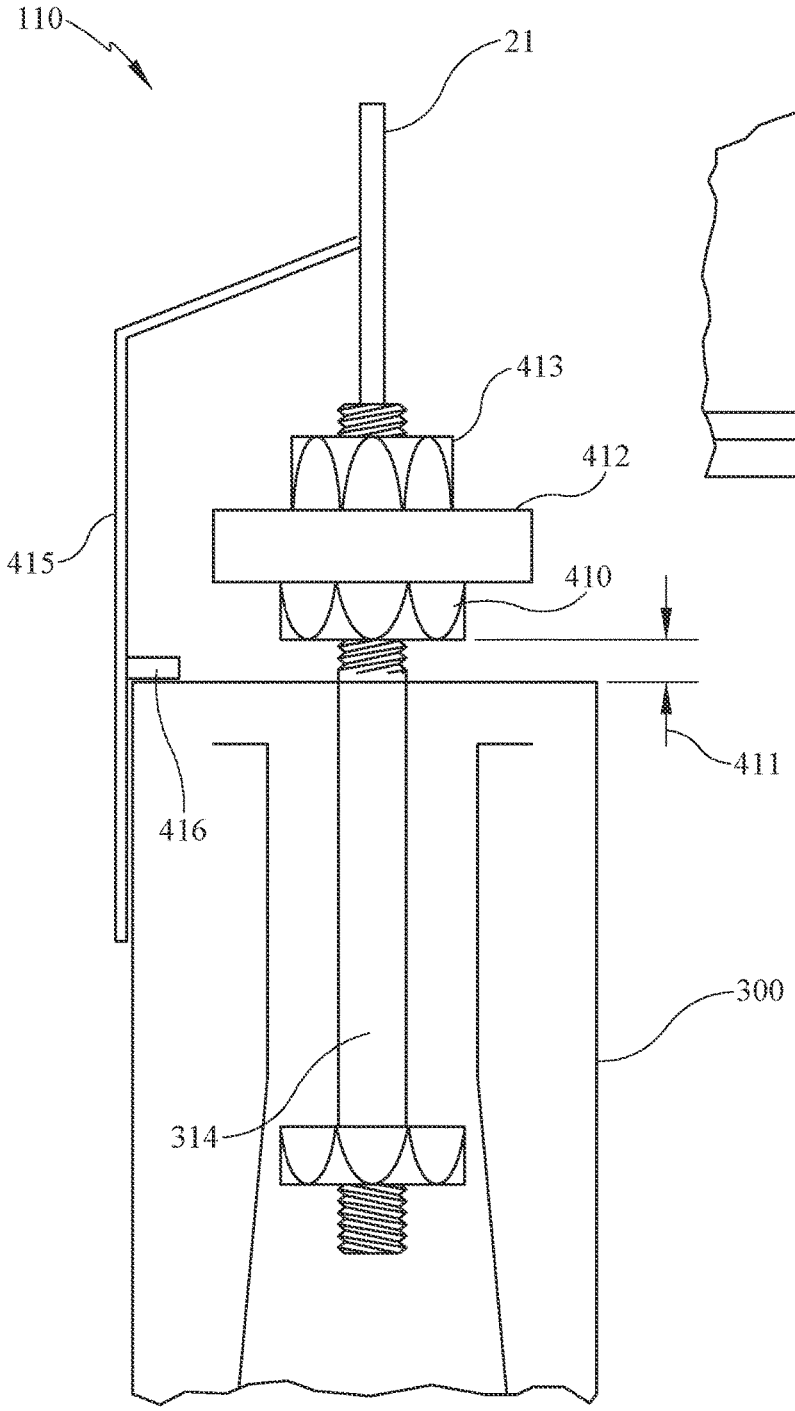
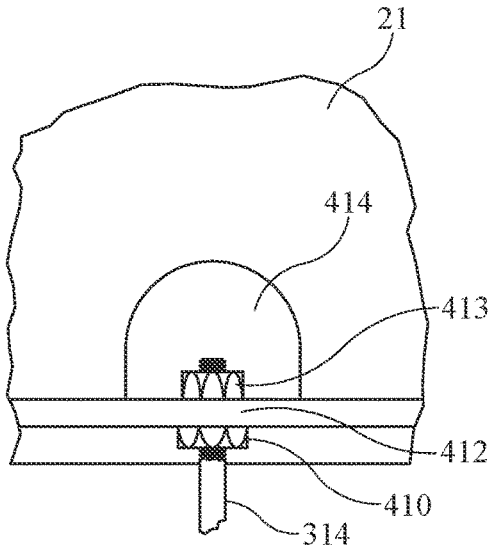
FIG. 12A
FIG. 12

COMPOSITE ELEVATED TANK AND METHOD OF CONSTRUCTION

BACKGROUND

Elevated water storage tanks come in a variety of sizes, styles, materials, and designs depending primarily on factors such as tank size requirements, site location, site geotechnical conditions and limitations, desired construction materials for the tank and for the supports (based on, for example, cost, availability, and design requirements), desired construction method, overall economics of the project, and so forth. In general there are four primary categories of elevated storage tanks: multi-column tanks; pedesphere tanks; fluted column tanks; and composite elevated tanks ("CET"). Each type of storage tank has a unique design and unique properties that require the incorporation of specific structures to the tank and specific construction methods for both fabrication of the tank components and construction of the final overall tank. In many cases, for example, what might be needed to construct, e.g., a multi-column tank is either not needed or in some cases is not appropriate for, e.g., a composite elevated tank.

Tank capacity and economics often play the largest role in determining what style tank is needed for any particular project. Multi-column tanks generally comprise a steel tank supported by multiple steel legs around the tank circumference extending down to a foundation. These tanks, generally speaking, are one of the more economical type of all steel construction, and they generally range in capacities from approximately 50,000 gallons to approximately 2 million gallons or greater. Pedesphere tanks generally comprise a spherical or spheroidal steel tank perched atop a single slender steel support column supported on a foundation. Pedesphere tanks generally range in capacities from approximately 50,000 gallons to approximately 1,500,000 gallons or greater. Fluted column tanks generally comprise a large steel tank supported by a single, large-diameter corrugated ("fluted") steel support column. Fluted column tanks generally range in capacities from approximately 250,000 gallons to approximately 3 million gallons or greater. Composite elevated tanks generally comprise a large steel tank placed atop a reinforced concrete pedestal support shaft. Composite elevated tanks generally range in capacities from approximately 500,000 gallons to approximately 3 million gallons or greater.

Material pricing and availability, site-related construction method options, and labor often are key factors in the overall economics of any given elevated storage tank project. For example, because of the extensive labor and cost involved in forming and constructing a reinforced concrete support shaft, composite elevated tanks are generally cost-effective in capacities of 500,000 gallons or more. This is due in part because the typical method of construction for such a tank size is to form and fully construct a reinforced concrete pedestal, followed by construction and placement of steel tank container on top of the final pedestal. It is currently not cost efficient to simultaneously construct the steel tank and the reinforced concrete pedestal.

However, composite elevated tanks offer important benefits over all-steel construction, such as, for example, requiring no coatings or painting of the concrete pedestal support. Given this and other benefits of composite elevated tanks, composite elevated tanks would be utilized to a much greater extent if their cost-efficiency for smaller tank sizes (non-limiting examples of approximately 300,000 gallons and less) could be improved. This requires a novel method of constructing composite elevated tanks, and also requires novel structures associated with the tank to facilitate proper connection between the steel tank and the concrete pedestal.

Accordingly, a need exists in the art for an alternative construction method for small composite elevated storage tanks. The need also exists in the art for a tank design that facilitates such a novel construction method.

SUMMARY

The present disclosure relates to a small composite elevated storage tank and a method for constructing same. The embodiments described herein streamline and simplify the construction of composite elevated tanks for smaller capacities of, for example, 300,000 gallons or less. In some embodiments, the concrete pedestal and steel tank container may be built concurrently, with the steel tank being lifted, in part or in total, onto the concrete pedestal.

In an embodiment, a method of building a composite elevated storage tank is provided comprising the steps of: building a reinforced concrete pedestal on a foundation at a storage tank site; coupling a tank anchor assembly with a top of the reinforced concrete pedestal; preparing a temporary tank support; building a steel tank on the temporary tank support, the steel tank having a first cone section, one or more levels of tank shell side wall, a roof, and a base plate; lifting the steel tank onto the reinforced concrete pedestal such that the base plate is positioned adjacent the tank anchor; and coupling the base plate to the tank anchor.

In an embodiment, a method of building a composite elevated storage tank is provide comprising the steps of: building a reinforced concrete pedestal on a foundation at a storage tank site by beginning with a first section of formwork for the pedestal and placing steel reinforcement and wet concrete inside the formwork and then repeating to achieve, with additional sections or lifts, an increasing height for the reinforced concrete pedestal until a penultimate level has been achieved; preparing a temporary tank support; building a steel tank on the temporary tank support by fabricating an assembly comprising a first cone section, a skirt welded to a bottom of the first cone section, and a base plate welded to a bottom of the skirt; placing the assembly on the temporary tank support by setting the base plate on the temporary tank support; continuing to build the steel tank from the bottom upwards by welding additional cone sections above the first cone section until a desired number of additional cone sections has been achieved; welding plates of a first level of tank shell to a top level of an uppermost cone section of the additional cone sections; continuing to add levels to the tank shell by welding plates of additional levels to each successive lower level until a desired height of the tank shell has been achieved; in the ultimate lift of the reinforced concrete pedestal, placing a tank anchor assembly at the top of the formwork for the final lift; lifting the steel tank onto the reinforced concrete pedestal such that the base plate is positioned adjacent the tank anchor; and coupling the base plate to the tank anchor.

In an embodiment, a method of building a composite elevated storage tank is provided comprising the steps of: building a foundation at a storage tank site; building a temporary tank support near the foundation and at the storage tank site; building a reinforced concrete pedestal on the foundation; fastening a tank anchor assembly onto the reinforced concrete pedestal; building a steel tank on the temporary tank support, the steel tank having a first cone section, one or more levels of tank shell side wall, and a roof, wherein the first cone section further comprises a skirt depending therefrom, and the skirt further comprises a base plate welded to a bottom of the skirt; lifting the steel tank onto the reinforced concrete pedestal such that the base plate sits on the tank anchor; and coupling the base plate to the tank anchor.

In an embodiment, a composite elevated storage tank is provided comprising a reinforced concrete pedestal having a generally open cylindrical shape, the reinforced concrete pedestal further comprising one or more tank anchor assemblies, wherein the tank anchor assemblies are coupled to a top of the reinforced concrete; a steel tank of a predetermined capacity, the steel tank having a bottom, a first cone section, sidewall, roof, and a base plate coupled to both the steel tank and the tank anchor.

In an embodiment, a composite elevated storage tank is provided comprising a reinforced concrete pedestal having a ring wall of reinforced concrete, the ring wall further comprising one or more tank anchor assemblies coupled to a top of the ring wall; a geometrically closed steel tank of a predetermined capacity having a bottom, at least one sidewall, and top, wherein the bottom further comprises a subassembly further comprising a first cone section, a skirt welded to a bottom of the first cone section, and at least one base plate welded to a bottom of the skirt; wherein the one or more tank anchor assemblies is coupled to the at least one base plate to the steel tank to the reinforced concrete pedestal.

In an embodiment, a composite elevated storage tank is provided comprising a reinforced concrete pedestal having a tank anchor assembly coupled to a top of the reinforced concrete pedestal with an insulator separating the tank anchor assembly and the top surface; a steel tank having a first cone section, one or more additional cone sections, one or more levels of tank shell side wall, and a roof, wherein the first cone section further comprises a skirt depending therefrom, and the skirt further comprises a base plate welded to a bottom of the skirt; wherein the base plate is coupled to the tank anchor.

These and other advantages and features, which characterize the invention, are set forth in the claims annexed hereto. For a better understanding of the invention, and of the advantages and objectives attained through its use, reference should be made to the Drawings, and to the accompanying descriptive matter, in which there is described example embodiments of the invention. This summary is merely provided to introduce a selection of concepts that are further described below in the detailed description and is not intended to identify key or essential features of the claimed subject matter, nor is it intended to be used as an aid in limiting the scope of the claimed subject matter.

BRIEF DESCRIPTION OF THE DRAWINGS

FIG. 12 is a partial front elevation view of an anchorage assembly according to a further alternative embodiment.

FIG. 12A is a partial cutaway of a side view of the anchorage assembly of FIG. 12.

DETAILED DESCRIPTION

Figures 1, 1A:
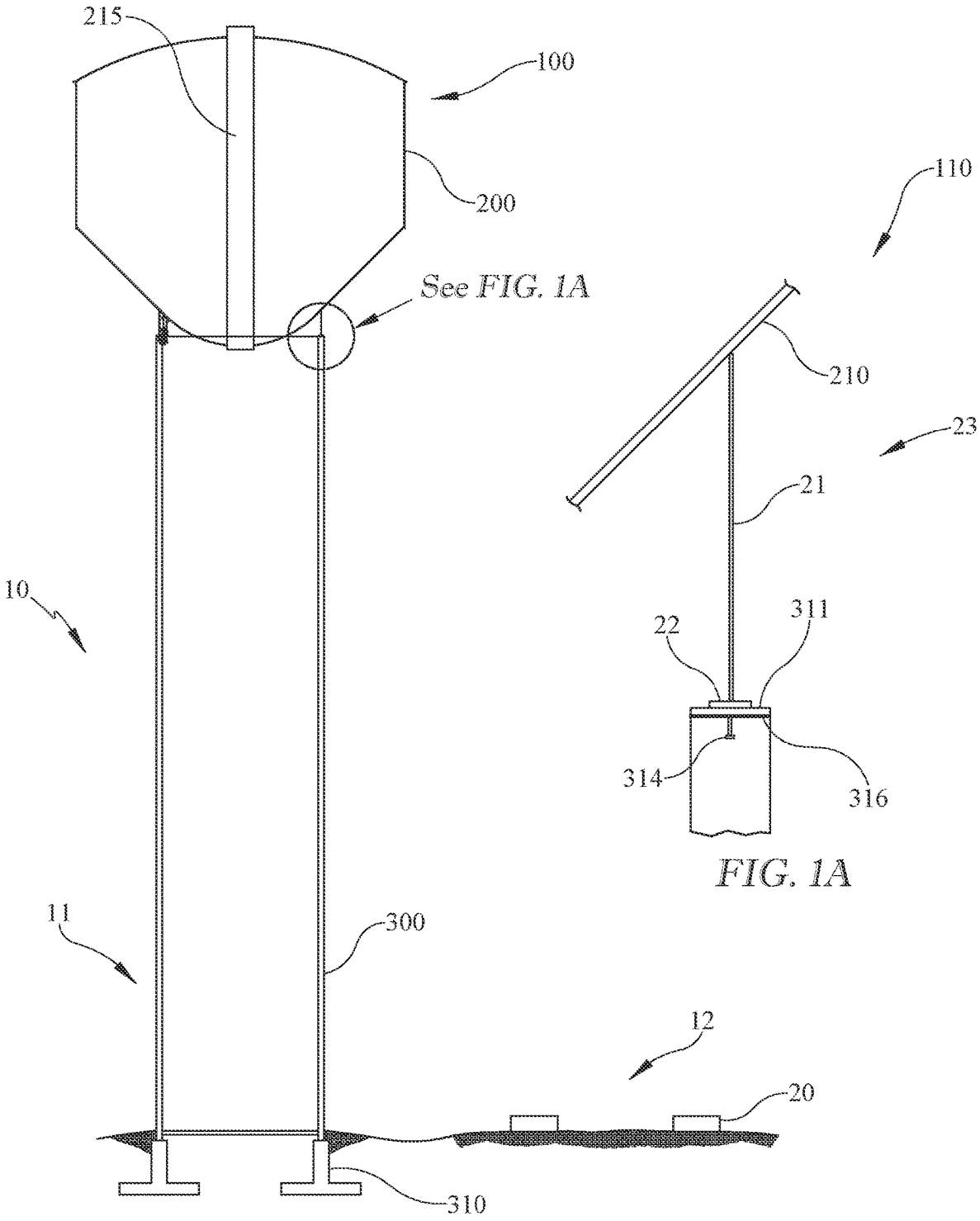
FIG. 1 is an elevation view of a representative elevated storage tank construction site showing a representation of a completed composite elevated tank.
FIG. 1A is a detail view of an exemplary connection between the steel tank and the reinforced concrete pedestal.

The embodiments discussed hereinafter are directed in part to a small capacity composite elevated storage tank and a method for constructing same. The functionality of the disclosed apparatus and method represents a significant improvement over known designs and methods. It is to be understood that neither the tank components described or shown herein, nor the method of constructing such an exemplary tank, is limited to the details of construction and the arrangement of components set forth in the following description or illustrated in the drawings, nor is the method of construction limited to the steps described or the order of steps described with reference to particular embodiments. Instead, exemplary methods to describe certain aspects of the preferred method of construction, and exemplary structures and features that enable such construction methods to be achieved are described herein. The described embodiments are exemplary in nature, and certain aspects of the structures may be capable of other embodiments and of being practiced or of being carried out in various ways. As will be described in detail below, the exemplary embodiments and descriptions serve to describe aspects and embodiments of the invention. To the extent that the embodiments described herein involve, in various stages, the use of known construction details and methods for aspects that are not directly relevant to the invention, a detailed discussion of such known details and methods will not be made herein. Also, it is to be understood that the phraseology and terminology used herein is for the purpose of description and should not be regarded as limiting.

Turning now to the drawings, wherein like numbers denote like parts throughout the several views, FIG. 1 depicts a representative composite elevated tank construction site 10 with a composite elevated tank depicted. The composite elevated tank includes a storage tank 100, which includes a steel tank 200 on top of a pedestal 300. The pedestal 300 is made of reinforced concrete. The pedestal 300 can be of various sizes and configurations depending on many factors, including, but not limited to, the capacity of the steel tank 200, site location and conditions, soil conditions, and quality and quantity of available materials. In general, however, for a composite elevated tank the reinforced concrete pedestal will take on an open cylindrical shape, having a circular ring-like cross section. Other cross sections are possible, of course, including elliptical and other geometric shapes. In general, the ring will have a thickness that is determined by structural design requirements based on anticipated loads and so forth. The interior of the reinforced concrete ring is typically, though is not required to be, open, which can facilitate storage therewithin or other uses by the storage tank owner. As depicted and described in the embodiments discussed herein, the pedestal 300 is an open cylindrical reinforced concrete ring having a circular cross section and an open interior. Embodiments described herein describe improvements in the construction of both the pedestal 300 and the steel tank 200 to enable an improved method of construction of the storage tank 100. As used herein, storage tank 100 refers to the overall composite elevated storage tank assembly of the steel tank 200 and the pedestal 300.

As part of the novel aspects of the embodiments described herein, the pedestal 300 and the steel tank 200 may be constructed concurrently or consecutively, and in either case the construction of each can be, but need not be, performed at the site 10. This determination is based on many factors, including site 10 space availability, field personnel availability, equipment availability, project schedule, and overall operations schedule. In the figures, the site 10 is shown to comprise two portions in proximity to each other at the site 10: site pedestal location 11 and temporary tank location 12. In practice, site pedestal location 11 and temporary tank location 12 can be in close proximity to each other at the site 10, or can be a significant distance from each other at the site 10. Further, the temporary tank location 12 could also be located in a completely different location not appurtenant to the site 10 (e.g., at a steel tank manufacturing facility).

Reinforced Concrete Pedestal Construction

As is commonly understood, in the process for building the storage tank 100 (and indeed for all types of elevated storage tanks in common usage), the foundation work to excavate and build the foundation 310 generally occurs first. The storage tank 100, in particular, the pedestal 300, is placed on foundation 310. The design and construction details of foundation 310 are well-known to engineers tasked with designing and building composite elevated tanks like storage tank 100, and depend on many factors, including the capacity of the steel tank 200, the size and shape of the pedestal 300, site 10 space, site 10 location, soil bearing capacity, and other commonly understood engineering design parameters, and will not be described in detail here. Suffice to say that a properly designed and constructed foundation 310 at the site 10 is required to provide adequate support for the storage tank 100. Once the foundation 310 has been constructed, work begins on building the pedestal 300. Building a reinforced concrete pedestal per se is, in general, commonly understood in the industry to involve placement of formwork that will receive and contain the wet concrete for curing. The forms are assembled in segments. Reinforcing steel, which can be mesh or deformed bar (re-bar), is then placed within the formwork. Once all reinforcing steel has been placed, wet concrete is then placed inside the formwork according to required project parameters and standards, and according to various known methods of construction. For example, some methods of building a pedestal involve working in "lifts" around the entire ring (360 degrees) in a given lift (e.g., four feet of height at a time), and then, once that lift has sufficiently cured, moving formwork to a higher elevation in a second lift, again all the way around the entire ring, and then continuing this process at each successively higher elevation. Other building methods, however, involve working on sections of the ring at a given time, and forming and pouring concrete to a higher elevation (as compared to the "lift" method), but only in one segment of the ring at a time (e.g., approximately 90 degrees of the ring). Other methods might involve a mixture of these two methods. Regardless of how the formwork and concrete is placed during construction of the pedestal 300, in general, the process of building the formwork, adding reinforcing steel, and pouring concrete continues upward as the concreted pedestal 300 continues to be constructed. The final pour for the pedestal 300 involves structures and methods not included in the construction of known composite elevated tanks and that facilitate the novel aspects of the embodiments described herein. These details will be described below.

Steel Tank Construction

Figure 2:
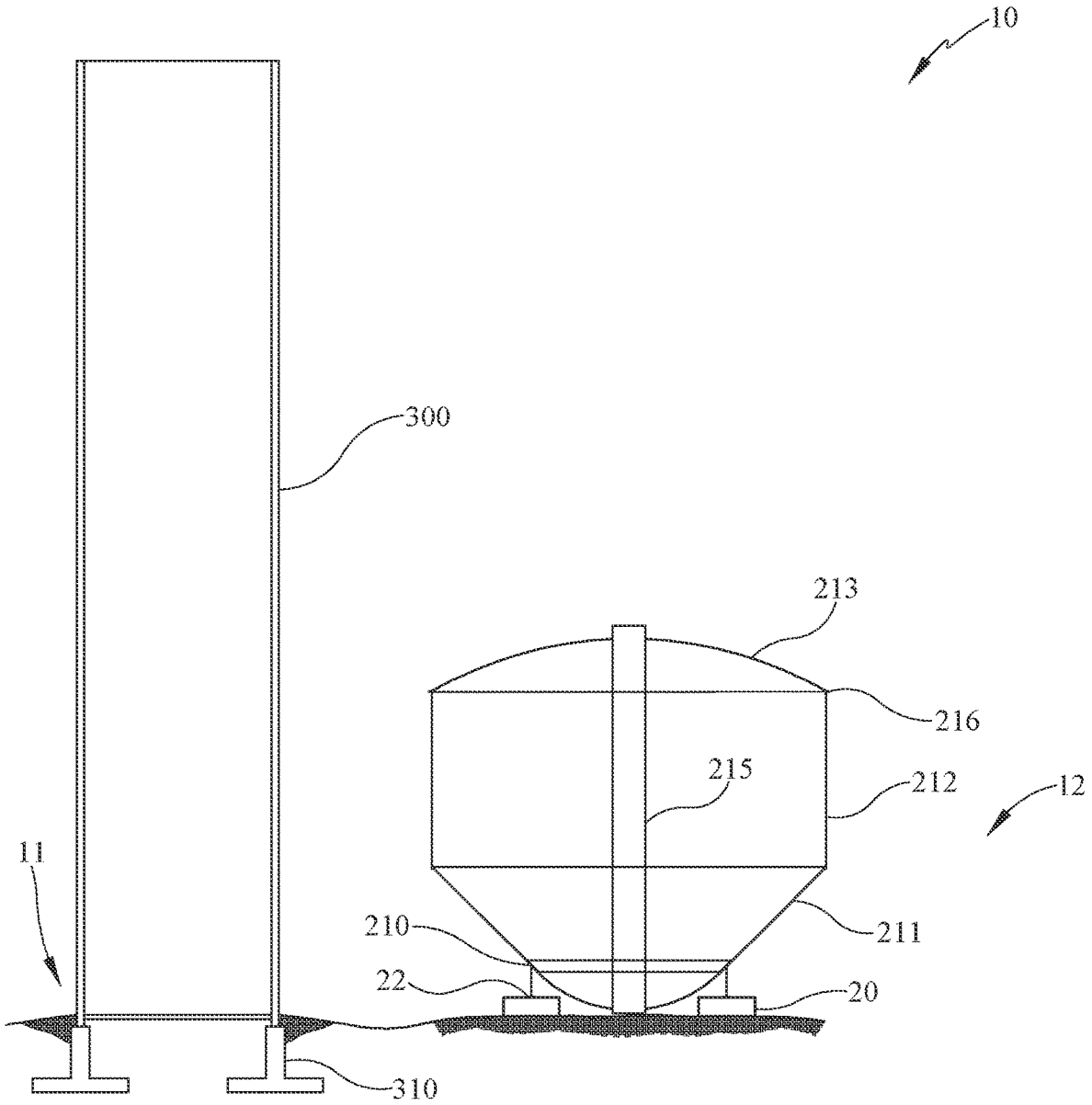
FIG. 2 is an elevation view of a representative elevated storage tank construction site showing a fully-constructed pedestal ready to receive a fully-constructed steel tank.
Figure 3:
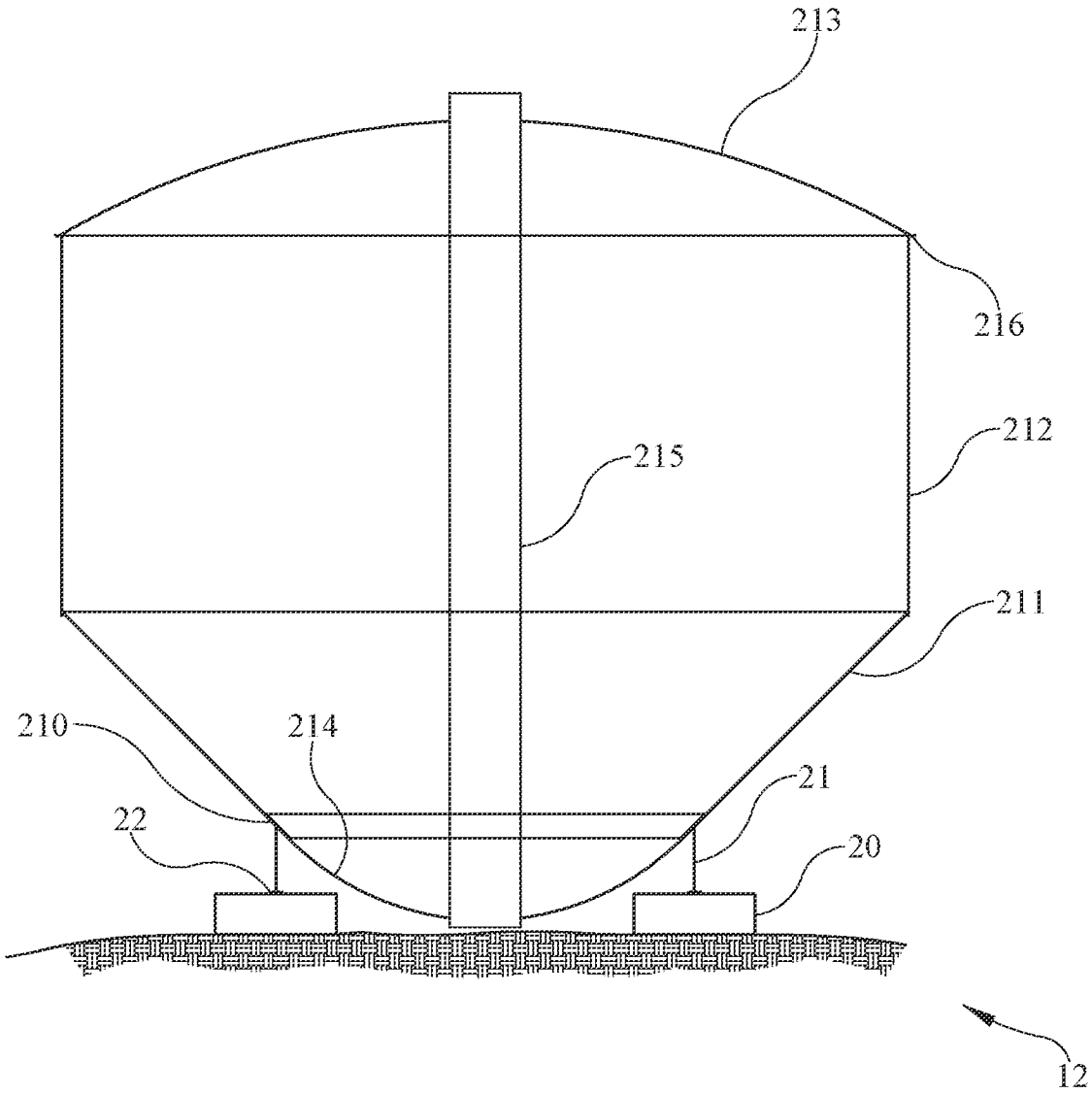
FIG. 3 is an elevation view of a steel tank fully constructed at a representative temporary tank elevated storage tank construction site at a seventh stage of construction.

With continued reference to FIG. 1, and additional reference to FIGS. 2 and 3, the steel tank 200 is depicted. FIG. 1 shows a fully constructed storage tank 100 at temporary tank location 12 which, in this embodiment shown, happens to be adjacent to site pedestal location 11. FIG. 2 shows the storage tank 100 in a penultimate stage of construction, wherein a fully-constructed pedestal 300 is ready to receive a fully-constructed steel tank 200. FIG. 3 shows a fully-constructed steel tank 200 as built at the temporary tank location 12, which could be adjacent to site pedestal location 11 if desired.

From FIG. 3 it can be seen that the steel tank 200 is, generally, an enclosed steel structure containing an open volume therein for storing water. The steel tank 200 can take on one of several shapes commonly used in the industry. The steel tank 200 can also, as discussed above, have one of many pre-determined capacities. The steel tank 200 depicted in one embodiment shown comprises several sections. Given that the steel tank 200 is a large structure in any given capacity, obviously the sections each comprise a multitude of steel plates making up each section. Many of these steel plates are pre-formed with a given shape or curvature so that, when welded together, result in a steel tank 200 of the desired size and shape, having the desired curvatures at the desired locations. For illustration purposes, one representative size and shape of a steel tank 200 is depicted in the figure. In the embodiment shown, a first cone section 210 and additional cone sections 211, the number of which depends upon the number of tank lifts (i.e., stages of construction of the individual steel plates as the tank is constructed from bottom to top) are needed for the particular size steel tank 200. The various plates of a tank shell 212 are welded together, and the lower most level of tank shell 212 is welded to the upper most level of cone section 211. A tank roof 213 is welded to the upper most level of the tank shell 212. The tank roof 213 can itself take on several shapes known in the industry, for example, a dome, a cone, or other shapes. For illustration purposes, a dome shape is shown in the figures for the tank roof 213.

Additional structures related to the steel tank 200 are optional and can be included, if desired. For example, some steel tanks 200 include therewithin an access tube 215. As is commonly understood in the steel tank industry, the access tube 215 serves as an access conduit within the tank section from the interior of the pedestal 300 to the tank roof 213. The figures depict an embodiment having an access tube 215, but an access tube is not required. The method of fabricating the steel tank 200 will now be described.

Temporary Tank Location

Figure 4:
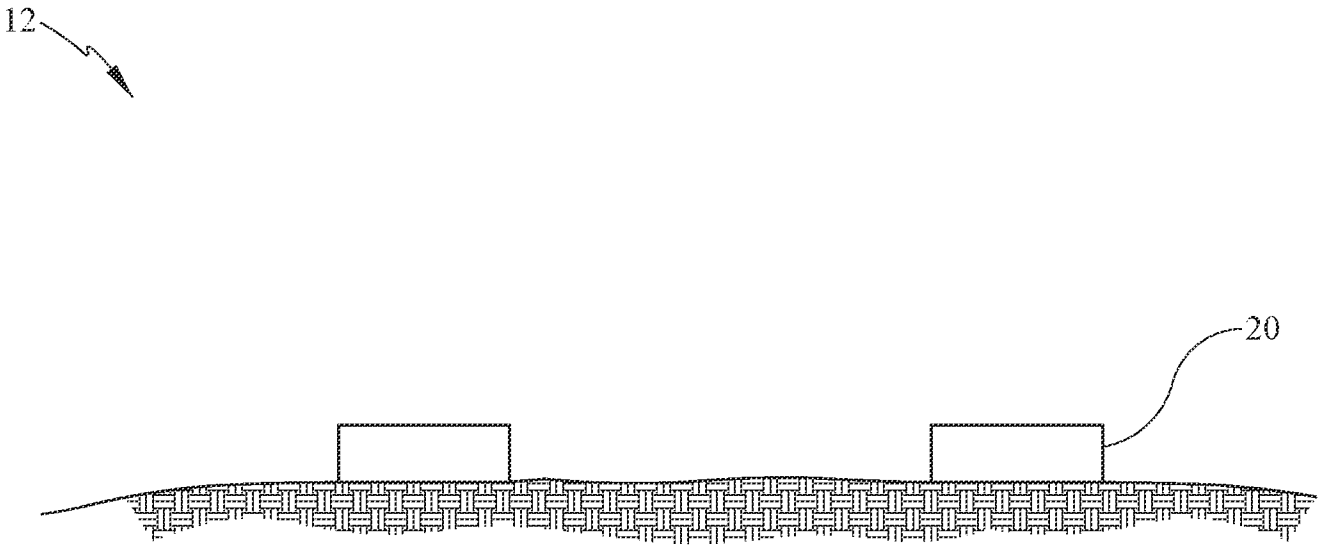
FIG. 4 is an elevation view of a representative elevated storage tank construction site at a first stage of construction.

Referring to FIGS. 4-9, an example temporary tank location 12 is depicted. The novel aspects of the embodiments described herein enable the construction of the steel tank 200 on the temporary tank location 12 and then lifted, in whole or in part, onto a fully-constructed pedestal 300. As mentioned previously, the temporary tank location 12 advantageously can be, but need not be, situated at the storage tank site 10. FIG. 4 depicts one embodiment of temporary tank construction supports 20 that are placed on grade (as shown) or on a suitable foundation. These temporary tank construction supports 20 are generally constructed before the steel tank 200 is constructed. The type, style, shape, location, and number of the temporary tank construction supports 20 depends on many factors, including the size of the steel tank 200 to be constructed, as well as the parameters associated with the site 10 and the geotechnical conditions at the site 10. The temporary tank construction supports 20 can be any of a number of items, including, without limitation, jigs formed to facilitate tank construction; boxes; concrete pads; or any item that is adequately strong, flat, and level, including, without limitation, the ground itself, gravel, and so forth. The temporary tank construction supports 20 could be numerous separate supports, or could be one or more continuous supports (e.g., ring walls of various materials, and the like). The temporary tank construction supports 20 should be installed such that their upper surfaces are level. For ease of description, the figures herein depict a generalized schematic of temporary construction supports 20 as being boxes placed on level grade. The temporary construction supports 20, when located at a temporary tank location 12 that is at or very near to the site 10, enable the construction of the steel tank 200 to be performed on site near site pedestal location 11. This enables the steel tank 200 and the pedestal 300 to be constructed either concurrently or consecutively, depending on preference. The construction of the steel tank 200 at grade at the temporary tank location 12 at the site 10 may consist of the constructing a suspended bottom 214 (if applicable), first cone section 210, additional cone sections 211, tank shell 212, tank roof 213, access tube 215, and rim angle 216 in total or in any partial combination, as desired. How much of the steel tank 200 that is constructed at the temporary tank location 12 depends on many factors, including availability of cranes of sufficient size, labor availability, and other project factors.

Figure 5:
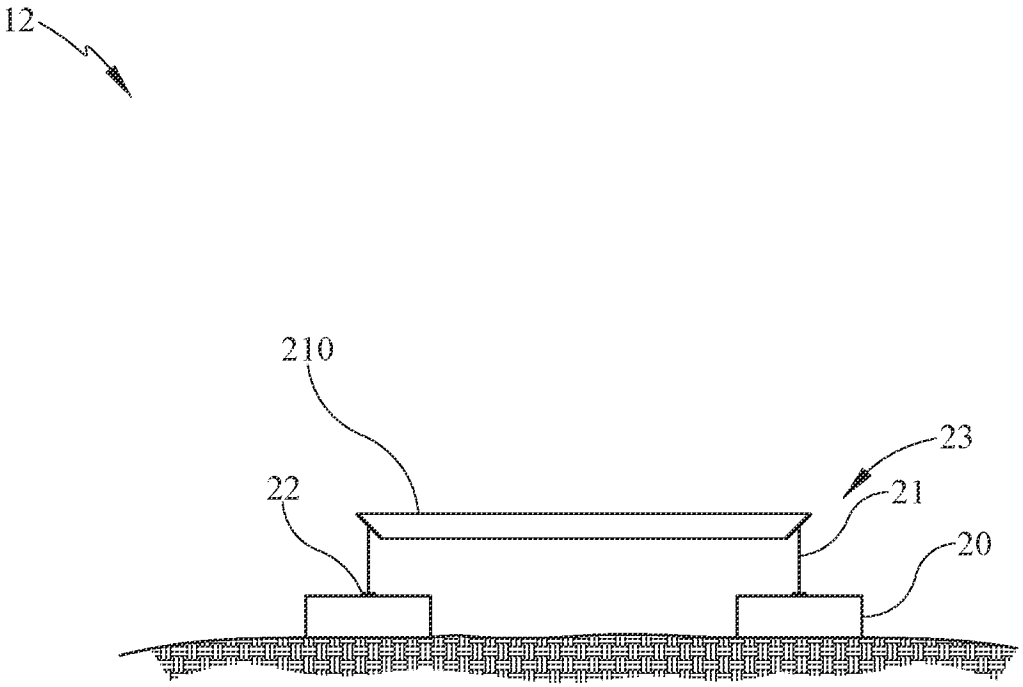
FIG. 5 is an elevation view of a representative elevated storage tank construction site at a second stage of construction.

FIG. 5 depicts a beginning stage of the steel tank 200 construction. In the figures herein, a skirt 21 is welded to one or more base plates 22. A first cone section 210 is welded to the top of the skirt 21. The first cone section 210, skirt 21, and base plates 22 can collectively be viewed as an assembly 23. The presence of a skirt 21, however, is not required in order to enable the method of constructing the storage tank 100 described herein. In an alternative embodiment, the first cone section 210 can be coupled (typically, though not necessarily, via welding, bolts, or a combination of same) directly to the base plates 22 with no skirt 21 in between. For ease of description, however, the figures show an embodiment using skirt 21.

Figure 6:
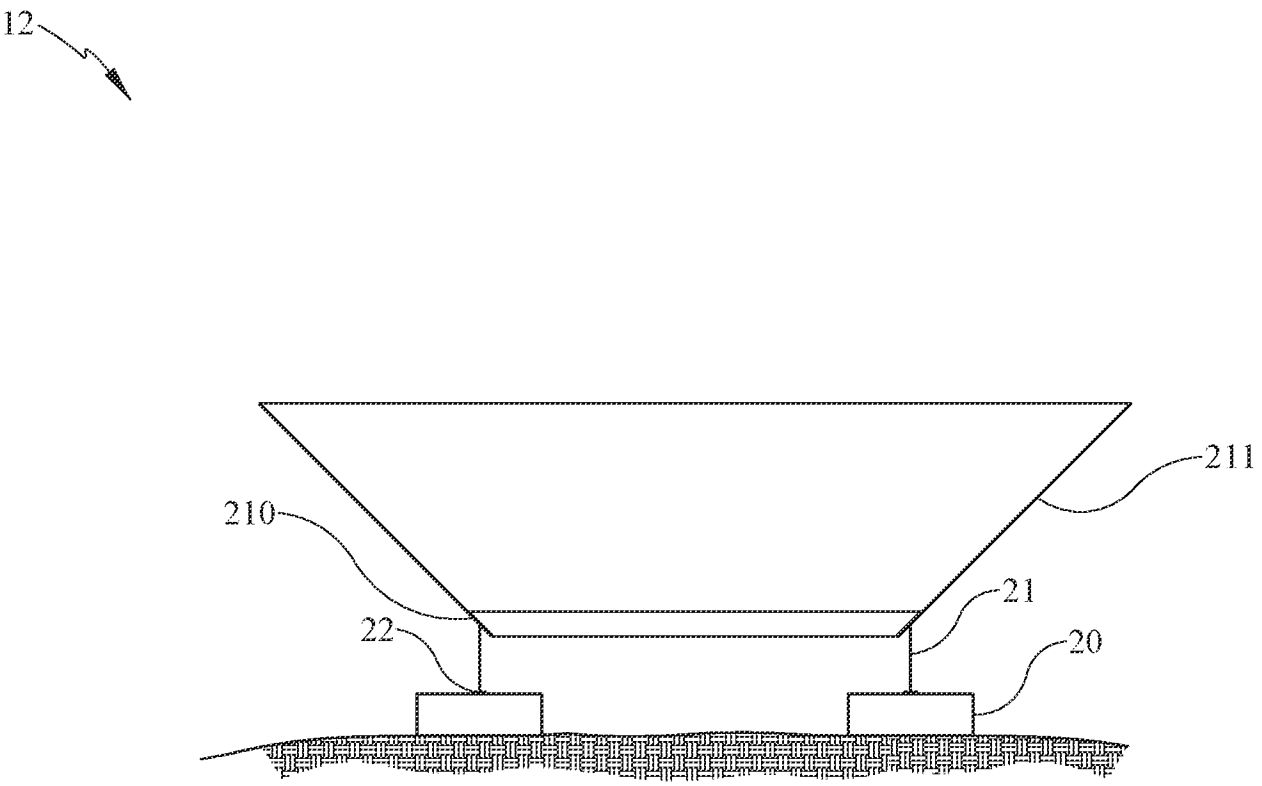
FIG. 6 is an elevation view of a representative elevated storage tank construction site at a third stage of construction.

In the embodiment shown in the figures, the assembly 23 can be fabricated off site and brought to the temporary tank location 12 as a whole, or the assembly 23 can be fabricated onsite at the temporary tank location, depending on preference. Preferably, the first cone section 210 is securely attached to the skirt 21 by double-sided fillet welding in the fabrication shop and then brought to the site 10 to be placed at the temporary tank location 12. Preferably the base plates 22, skirt 21, and first cone section 210 are fabricated at a fabrication facility and brought to the site 10 as a prefabricated assembly 23. This can ensure, among other things, that the assembly 23 is level and that necessary tolerances can be achieved. Once on site 10, the assembly 23 is placed atop the temporary tank construction supports 20. The assembly is then checked for level. As shown in FIG. 6, the remaining rings of the additional cone sections 211 are fabricated and placed. The assembly 23 will be also discussed below in relation to its novel function to finally and permanently connect the steel tank 200 to the concrete pedestal 300.

Figure 7:
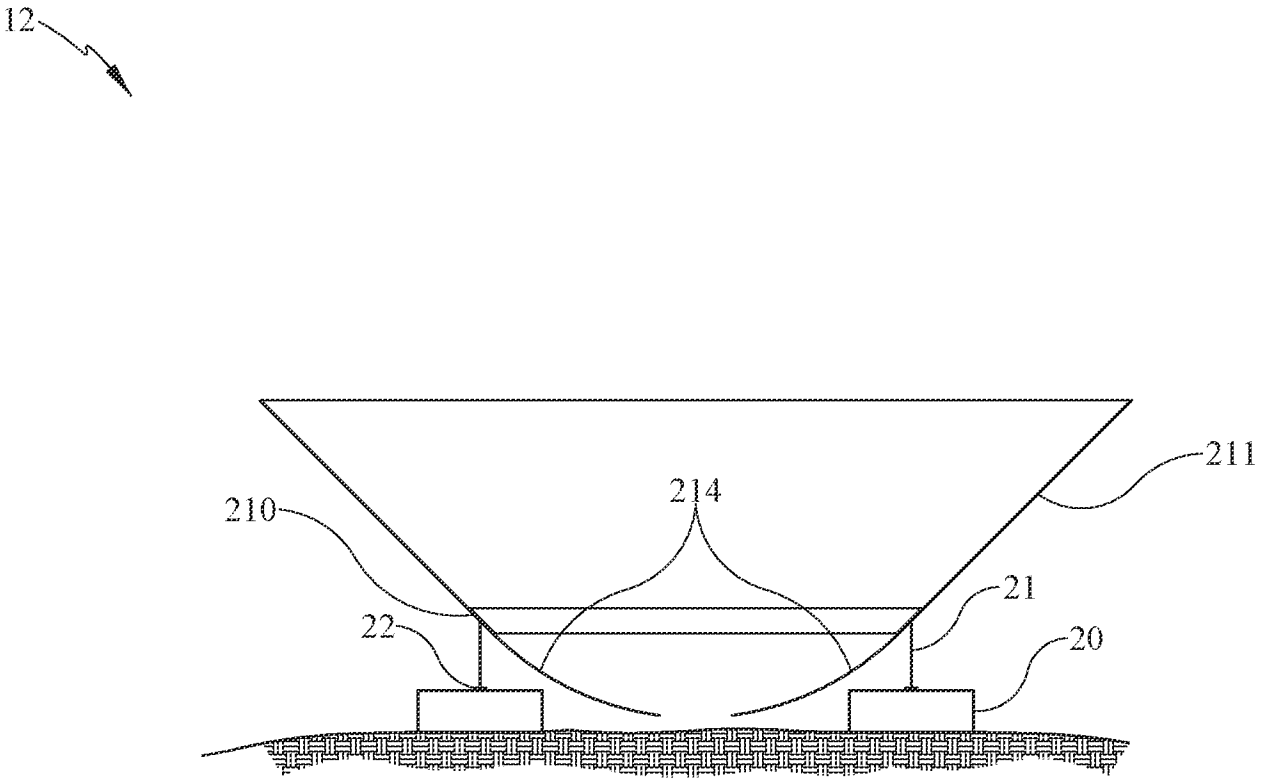
FIG. 7 is an elevation view of a representative elevated storage tank construction site at a fourth stage of construction.

In FIG. 7, the steel tank 200 is depicted as having a suspended bottom 214. This is one of several types of bottoms that are possible. For instance, the bottom could be, if desired, not a suspended bottom 214 but rather be supported by a concrete slab or a concrete dome. For ease of description, the embodiments shown depict a steel tank 200 having a suspended bottom 214. The suspended bottom 214 comprises multiple plates that are pre-formed to assume the appropriate size and shape for the desired bottom of the steel tank 200. The plates of the suspended bottom 214 are placed on the underside of first cone section 210. If other structures are to be employed in the steel tank 200 (such as, for example, an access tube 215), additional components and/or permanent or temporary supporting structures may be utilized to support and construct such structures (such as, for example, braces, supports, false risers, etc.) as is known in the industry.

Figure 8:
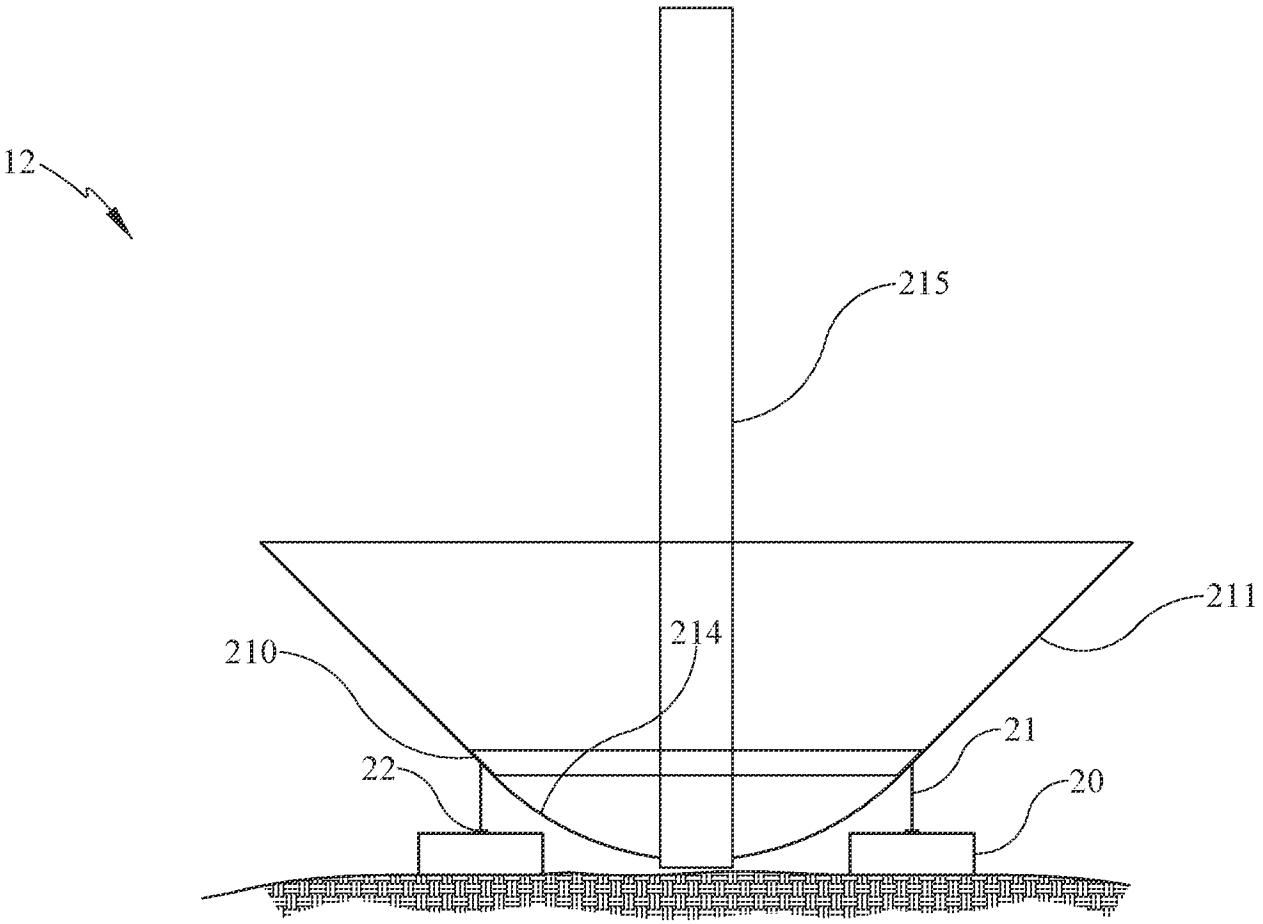
FIG. 8 is an elevation view of a representative elevated storage tank construction site at a fifth stage of construction.
Figure 9:
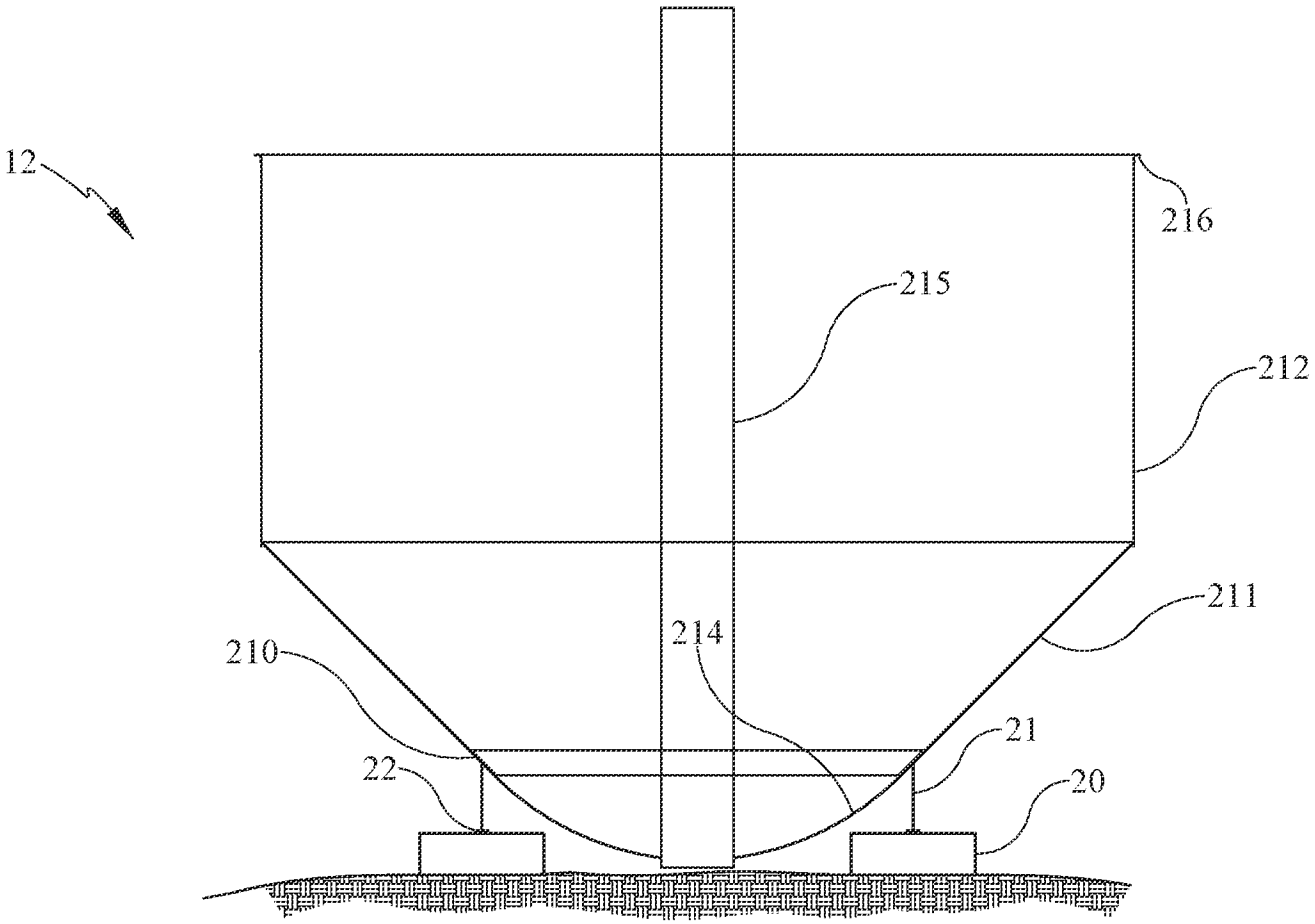
FIG. 9 is an elevation view of a representative elevated storage tank construction site at a sixth stage of construction.

As discussed above, the figures depict an embodiment that includes as access tube 215, but such is not required. In FIG. 8, the access tube 215 has been fabricated and inserted into the suspended bottom 214. Typically a closure bottom plate (not shown) will be welded to the access tube 215, which ties the access tube 215 to the suspended bottom 214. But, as discussed above, these and other methods of constructing the access tube 215 are possible and are not required nor discussed in detail. In FIG. 9, the tank shell 212 is generally constructed, from the bottom up, by welding the plates that comprise the tank shell 212, according to acceptable standards and known methods. An upper rim angle 216 is then welded to the top of the topmost plate making up the tank shell 212, to provide the transition to the roof. The upper rim angle 216 resists the outward horizontal forces of the tank roof 213 at the top of the uppermost tank shell 212. Referring again to FIG. 3, the tank roof 213 is welded to the rim angle 216 and, if present, also to the access tube 215. At the stage of construction shown in FIG. 3, the steel tank 200 is structurally complete. With reference again to FIG. 2, both the steel tank 200 and the pedestal 300 are structurally complete, at the site 10, and ready for attachment of the steel tank 200 to the pedestal 300.

Anchorage of Tank to Pedestal

Figure 10:
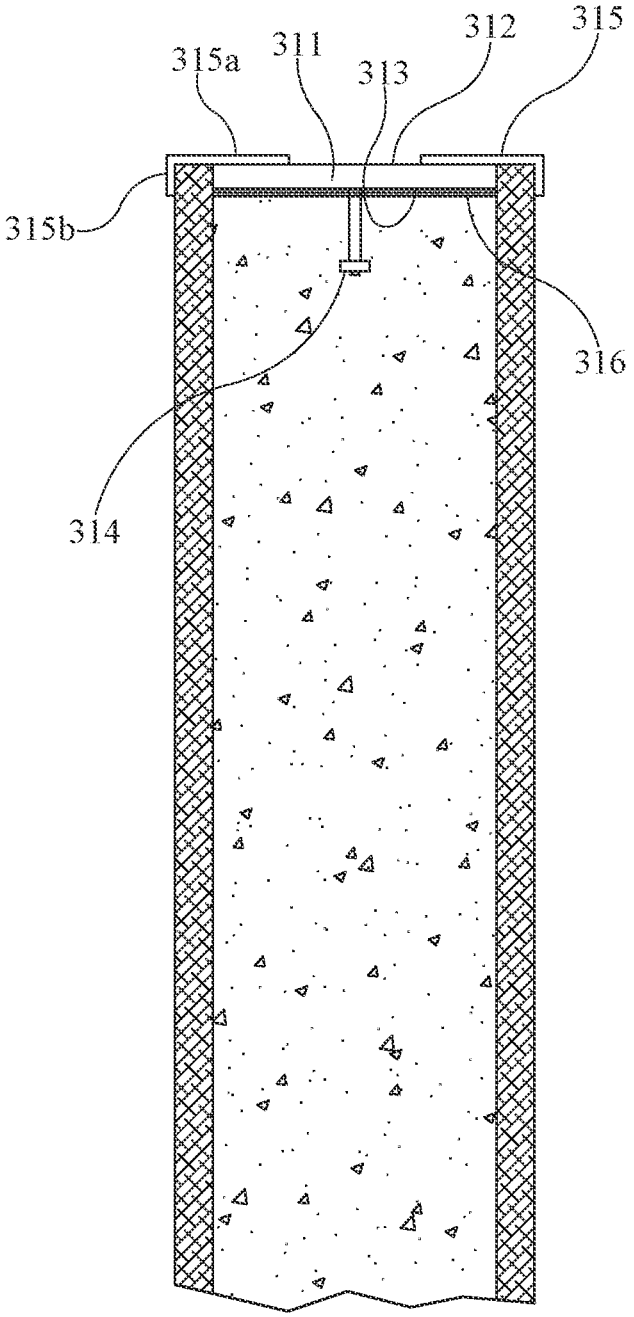
FIG. 10 is a partial section view of a portion of the reinforced concrete pedestal, according to an embodiment.

Referring again to FIG. 1, and with additional reference to FIGS. 1A and 10, one embodiment of the structures that enable the method of construction of the storage tank 100 and that enable the cost-efficient and structurally sound anchorage of the steel tank 200 to the pedestal 300 is shown. FIG. 1A is a detail view of the portion of the storage tank 100 at the location where the steel tank 200 attaches to the pedestal 300. Placing a fully-constructed steel tank 200 atop a fully-constructed reinforced concrete pedestal 300 involves a unique anchorage assembly 110. Several embodiments of anchorage assembly 110 are possible. The figures show one embodiment in particular, for ease of discussion.

Prior to setting the steel tank 200 atop the pedestal 300, a portion of the anchorage assembly 110 described herein is preferably pre-fabricated at a fabrication shop and then brought to the site 10. FIG. 10 is a partial section view showing the details of the final concrete pour for the pedestal 300. In the embodiment shown, one or more (preferably pre-fabricated) tank anchor assemblies 311 is shown. As discussed above, the assembly 23 can take on a variety of designs and structures, and so can the tank anchor assemblies 311. The tank anchor assemblies 311 work with the assembly 23 to comprise the anchorage assembly 110 that structurally secures the steel tank 200 to the pedestal 300. Alternative embodiments of the assembly 23 and/or the tank anchor assemblies 311 are described later. In the embodiment depicted in FIGS. 1-10, the tank anchor assemblies 311 take the form of a plate having a top surface 312 and a bottom surface 313. The tank anchor assemblies 311 can comprise multiple tank anchor assemblies 311 spaced around the ring of the pedestal 300, or in some embodiments can comprise a single continuous plate ring tank anchor. In the preferred embodiment, the tank anchor assemblies 311 comprise multiple plates, and each of the tank anchor assemblies 311 is placed into the formwork of the upper most level of the concrete pour of the pedestal 300, prior to the final concrete pour, so as to be cast into the concrete of the pedestal 300. The number and size of the tank anchor assemblies 311 are determined, primarily, based on the loads being transferred from the steel tank 200 to the concrete pedestal 300. In the embodiment shown, one or more anchors 314 extends from the bottom surface 313 of the tank anchor assembly 311 so that it extends below the tank anchor assembly 311 and into the concrete. In this way, the anchor 314 is captured in the wet concrete and, once the concrete cures, becomes a strong and permanent connection between the concrete of the pedestal 300 and the tank anchor assembly 311. Where the tank anchor assembly 311 is a plate, as shown in the figures, the anchors 314 are typically welded to the bottom surface 313 so that they may be situated securely into the concrete. The anchors 314 can be of many types and sizes, including, for example, studs, headed bolts, angled or "J-bolts", or any size and shape of steel designed to adequately handle the loads being transferred from the steel tank 200 to the concrete pedestal 300. In the embodiment shown in the figures, the anchors 314 are headed bolts. Preferably, the tank anchor assembly 311 extends the full width of the concrete wall that makes up the upper ring of the pedestal 300.

The top surface 312 of the tank anchor assemblies 311 in the embodiment shown in the figures should be flush with the top of the formwork so that the tank anchor assembly 311 extends neither above nor below the final top surface of the top of the concrete comprising the pedestal 300. This will ensure the tank anchor assemblies 311 will be level in relation to each other and to the top of the concrete surface. To facilitate this, one or more temporary anchor embedment wing plates 315 can be utilized to position and temporarily secure the tank anchor assemblies 311. In the embodiment shown, each temporary anchor embedment wing plate 315 comprises a generally "L" shape, having a first leg 315*a* and a second leg 315*b* disposed at a right angle to the first leg 315*a*. The temporary anchor embedment wing plates 315 are placed atop the final, uppermost formwork for the pedestal 300 such that first leg 315*a* resides atop the formwork and second leg 315*b* resides in contact with the side of the formwork. If desired, the temporary anchor embedment wing plates 315 may be temporarily secured to the formwork, e.g., by tack welding, nailing, screwing, adhesive, or other releasable means of attachment. The temporary anchor embedment wing plates 315 are removed as the formwork for the upper ring is removed.

During the stage of attaching (described below) the steel tank 200 to the pedestal 300, welding will be performed in close proximity to the concrete at the upper surface of the pedestal 300. In general, the welding of a steel member to another steel member that is embedded in concrete is not preferred practice. The heat of the welding process can cause concrete damage, which in turn can compromise strength and function. Therefore, prior to placing the tank anchor assemblies 311 for securement into the wet concrete, an insulator 316 is used to provide thermal insulation between the tank anchor assembly 311 and the upper surface of the concrete at the top of the pedestal 300. The insulator 316 can comprise one or more of several types and materials. For example, the insulator 316 can take the form of one or more solid pieces of discrete insulating material of any known material (e.g., cellulose; fiberglass; mineral wool; polymers; thermoplastics; natural materials; various other types of fibrous and non-fibrous, woven and non-woven, cross-linked and non-cross-linked materials; and the like having insulative properties) that can be cut to size and placed between the tank anchor assembly 311 and the upper surface of concrete. Alternatively, the insulator 316 can comprise one or more coatings, cementitious materials, fire-proofing materials, and the like that can be applied to the concrete, the tank anchor assemblies 311, the anchors 314, and/or any or all of these, that provide insulative properties. An example of a cementitious coating that can be applied to the concrete is a trowel-on material, such as a Portland cement based cementitious fireproofing material, available from Carboline and sold under the mark "Pyrocrete 241 HY". Alternatively, the insulator 316 may comprise one or more additional plates (e.g., steel), separate or coupled to the tank anchor assembly 311, or even a thickened version or thickened area of tank anchor assembly 311. Any one or more of these insulators 316, in any combination, may be employed to provide the desired insulation to protect the concrete from the heat of welding. For ease of description, FIG. 10 shows the use of an insulator 316 comprising a separate, discrete insulating pad. The insulator 316 and the tank anchor assemblies 311 of FIG. 10 are placed into/onto the formwork. After the concrete has cured and the formwork is removed, the upper section of the pedestal 300 appears as shown in FIG. 1A.

After the pedestal 300 has been completed (with the embedment into the concrete of the anchors 314 of the tank anchor assemblies 311), the upper part of the pedestal 300 is now ready to receive the steel tank 200. With continuing reference to FIGS. 1A and 2, the steel tank 200 is lifted from the temporary tank construction supports 20 (e.g., with a suitably sized crane) and placed on top of the pedestal 300. The steel tank 200 is situated and oriented such that the base plates 22 sit on top of the top surface 312 of the tank anchor assemblies 311. The base plates 22 are then welded to the tank anchor assemblies 311 to finally and permanently fasten the steel tank 200 to the pedestal 300.

Figure 11:
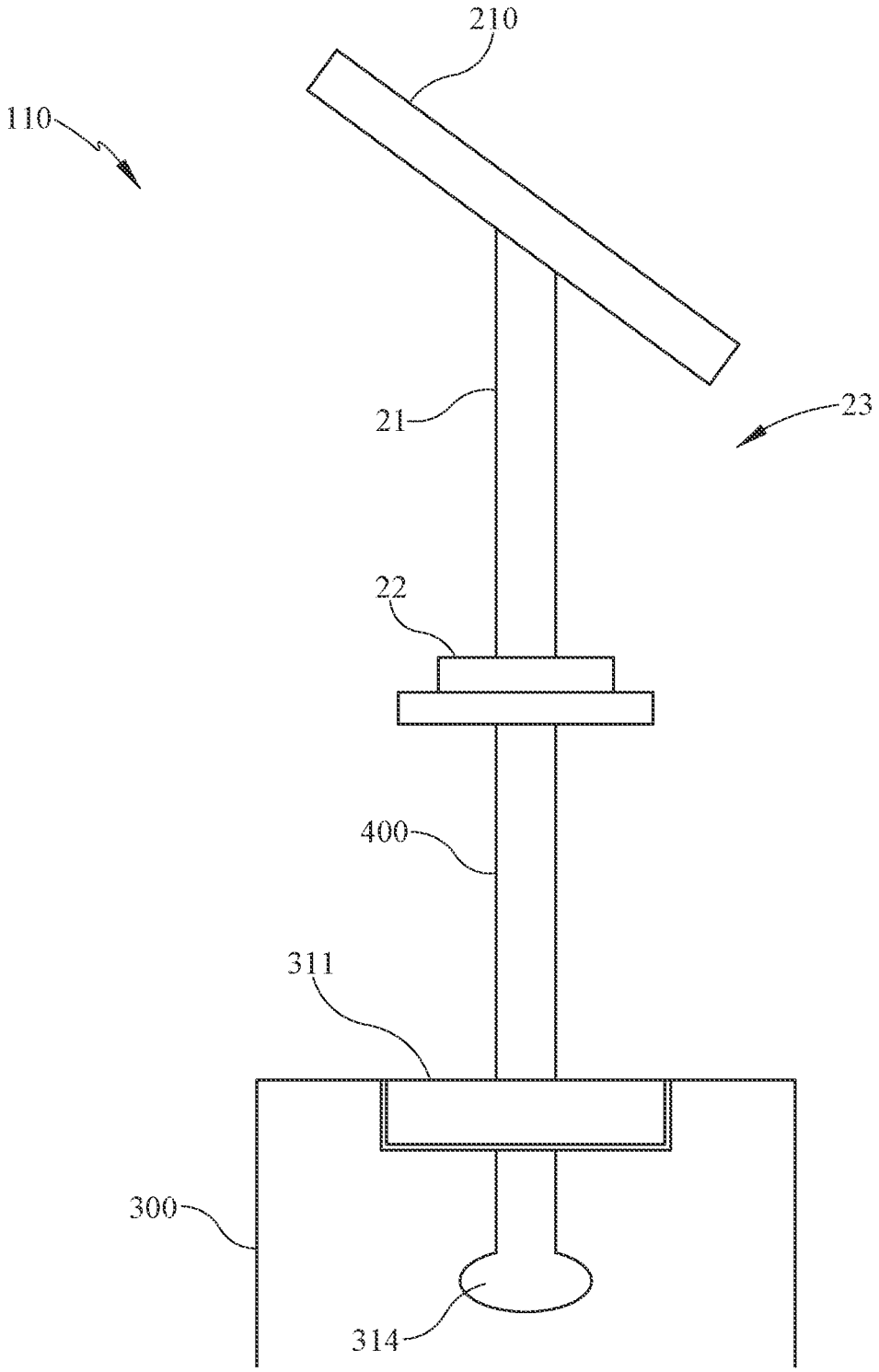
FIG. 11 is an elevation view of an anchorage assembly according to an alternative embodiment.

As discussed previously, the anchorage assembly 110 (e.g., the tank anchor assemblies 311 and/or the assembly 23) can take on a variety of designs, it being the goal to provide a secure attachment of the steel tank 200 to the pedestal 300. FIGS. 11-16 depict various alternative embodiments of the anchorage assembly 110. FIG. 11 depicts an alternative anchorage assembly 110 wherein a riser 400 is located between the assembly 23 and the tank anchor assemblies 311. In this embodiment it is possible to assemble the riser 400 offsite at an assembly shop, and field assemble the assembly 23, if desired.

FIGS. 12 and 12A depict a further alternative embodiment in which the anchor 314 (e.g., a galvanized anchor bolt) extends both into the concrete and also above the upper surface of the concrete. A leveling nut 410 (e.g., galvanized) is threaded onto a top of the anchor 314, and can leave a gap 411 (e.g., approximately one inch, more or less) between the leveling nut 410 and the upper surface of the concrete. A base 412 is placed above the leveling nut 410 and below a nut 413. The skirt 21 can be coupled to the base 412, and a window 414 can be cut into the skirt 21 to provide access to the nut 413, base 412, and leveling nut 410. A flashing 415 can be welded to the skirt 21 and can overhang the top of the concrete by an amount (as an example, approximately 1 inch to approximately 20 inches, but preferably approximately 2 inches to approximately 12 inches, and more preferably approximately 3 inches to approximately 5 inches) adequate to facilitate proper positioning of the skirt 21. Also, a flat bar 416 can be welded to the flashing 415 to facilitate placement and assembly. After the steel tank 200 is leveled, the flashing 415 with the flat bar 416 can be rested on top of the concrete wall, and the skirt 21 can be welded to the base 412.

Figure 13A:
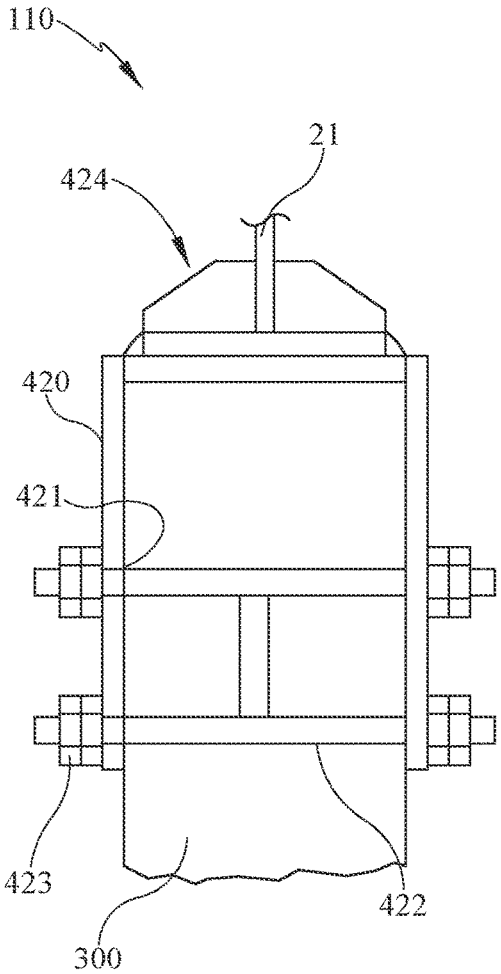
FIG. 13A is a partial front elevation view of an anchorage assembly according to a further alternative embodiment.
Figure 13B:
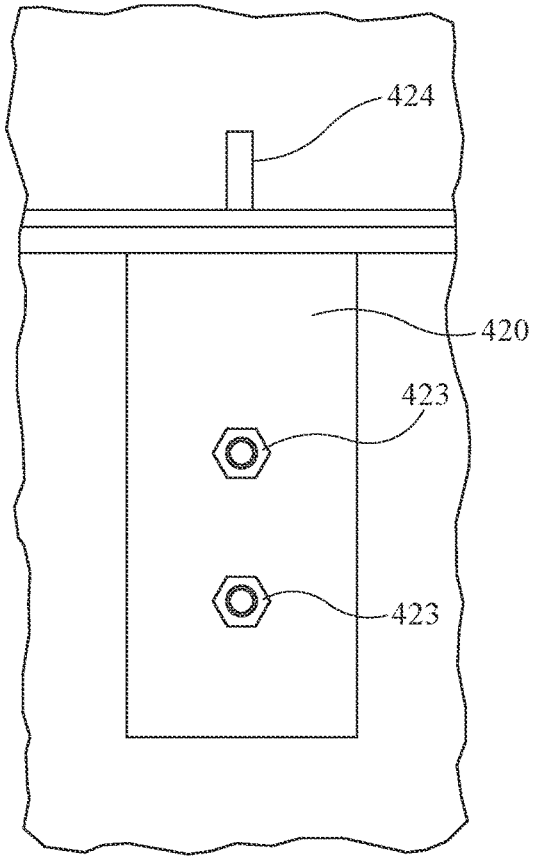
FIG. 13B is a cutaway side view of the anchorage assembly of FIG. 13A.
Figure 13C:
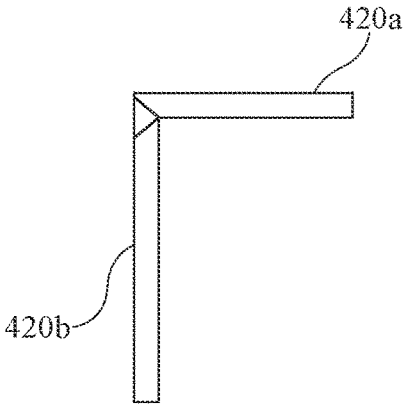
FIG. 13C is an elevation view of an anchor plate of the anchorage assembly of FIG. 13A.

FIGS. 13A, 13B, and 13C depict a further alternative embodiment wherein the tank anchor assemblies 311 comprise anchor plates 420 having one or more holes 421 therein to receive one or more anchor bolts 422. The anchor plates 420 can be angle plates having a first leg 420*a* and a second leg 420*b*. The anchor bolts 422 can be cast-in-place in the concrete of the pedestal and extend through the holes 421 in the second leg 420*b*. Nuts 423 are threaded onto the ends of the anchor bolts 422 to securely fasten the anchor plates 420 to the concrete. The skirt 21 can have a gusset 424 welded to its lower portion to provide a surface to weld to the first legs 420*a*.

Figure 14:
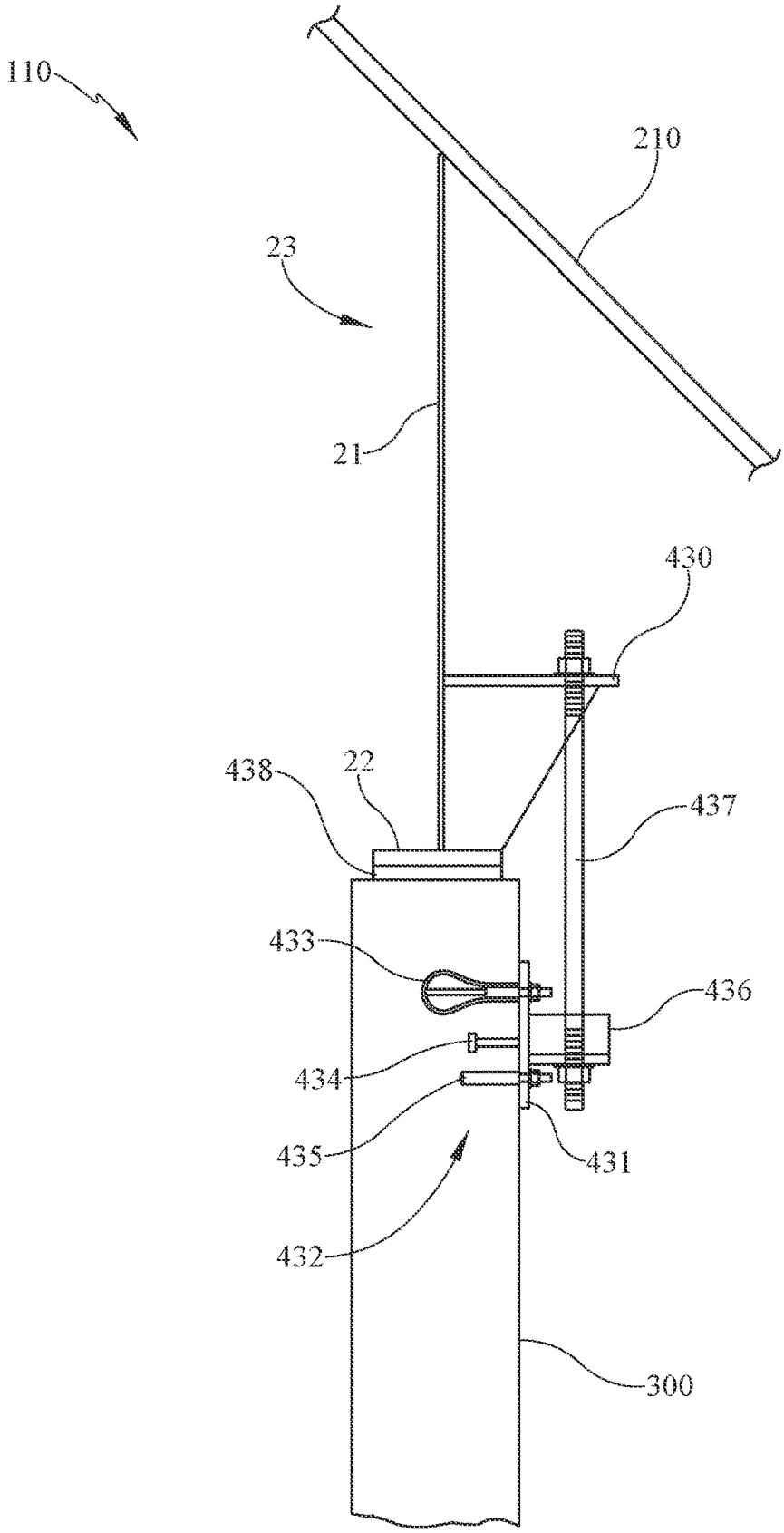
FIG. 14 is an elevation view of an anchorage assembly according to a further alternative embodiment.

FIG. 14 depicts a further alternative embodiment of the anchorage assembly 110. The skirt 21 is similar to that shown in FIGS. 1-10, however it also includes an inwardly-facing anchor chair 430. Instead of having an anchor bolt 314 embedded in concrete as in FIGS. 1-10, the anchorage assembly includes an anchor plate 431 mounted to an inner surface of the concrete. One or more embedded anchors 432 couple the anchor plate 431 to the concrete. The embedded anchors 432 can be any form of cast-in-place anchor 433, embedded stud 434, or can be an anchor 435 installed after the concrete has cured. The anchor plate 431 includes a support 436. An anchor bolt 437 is coupled at one end to the anchor chair 430 and at its other end to the support 436. From the figure it can be seen that the anchor bolt 437 is disposed laterally from the sidewall of the reinforced concrete of the pedestal 300. The anchor bolt 437 is then tightened (using various known nuts, etc.) to securely fasten the skirt 21 (and, thereby, the steel tank 200) to the pedestal 300. One or more additional grout/grout plates 438 can be used between the base plate 22 and the pedestal 300.

Figure 15:
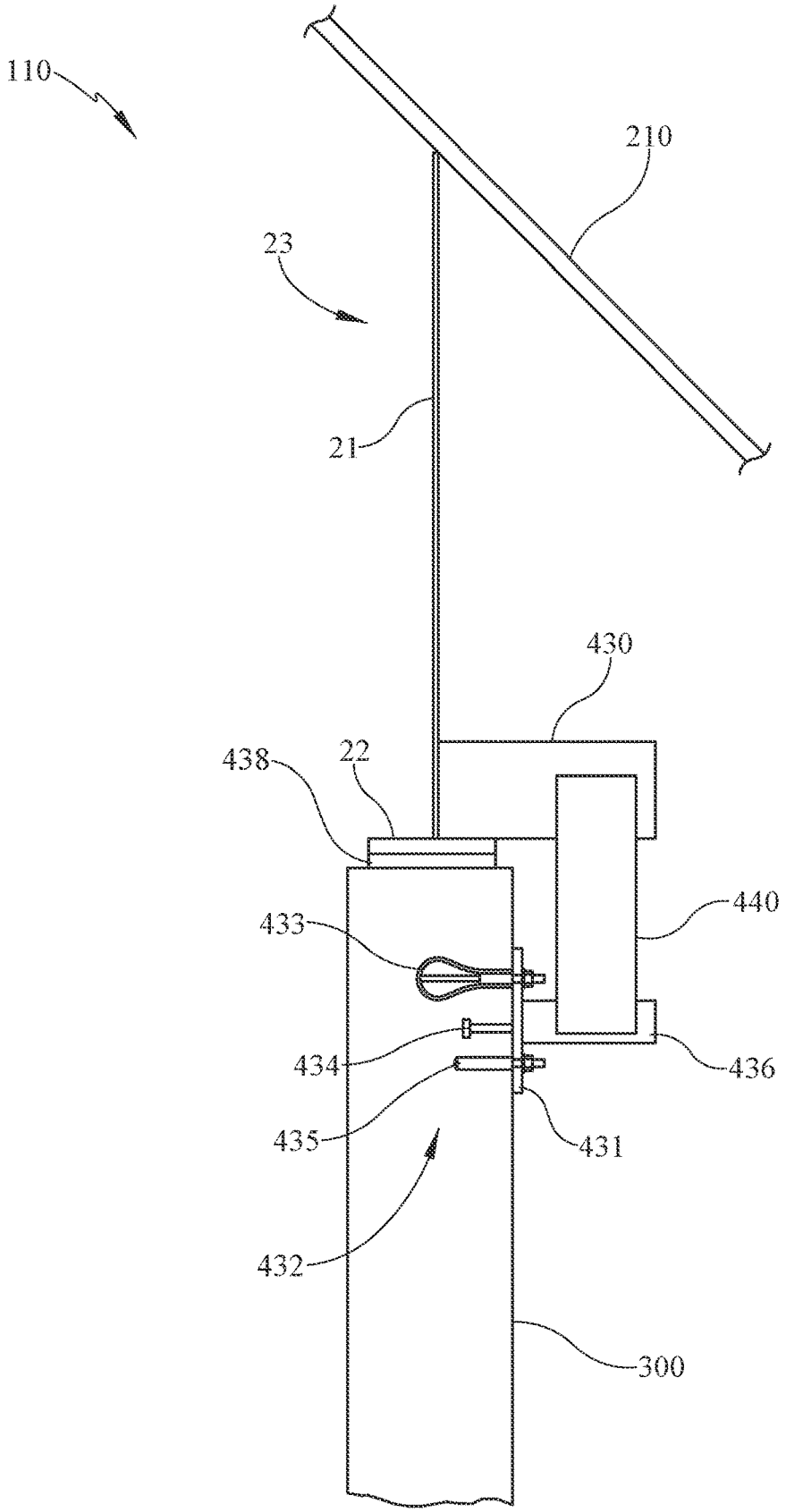
FIG. 15 is an elevation view of an anchorage assembly according to a further alternative embodiment.

FIG. 15 depicts a further alternative embodiment of the anchorage assembly 110. This embodiment is similar to that shown in FIG. 14. In place of the anchor bolt 437, however, there is a connector 440, which connects the anchor chair 430 to the support 436. The connector 440 can be basically any structural member having adequate strength to handle the anticipated applied loads. For example, the connector 440 can be any structural component of any common shape (e.g., plate, bar, angle, I-beam, channel, tube, and the like), and is only generically represented in FIG. 15. Similarly, the anchor chair 430 can take on many sizes and shapes and have the requisite connections to handle the coupling of the connector 440. The connections between the anchor chair 430 and the connector 440, and also the connector 440 and the support 436 can be of any common type adequate to handle the load (e.g., welded, bolted, and so forth).

Figure 16:
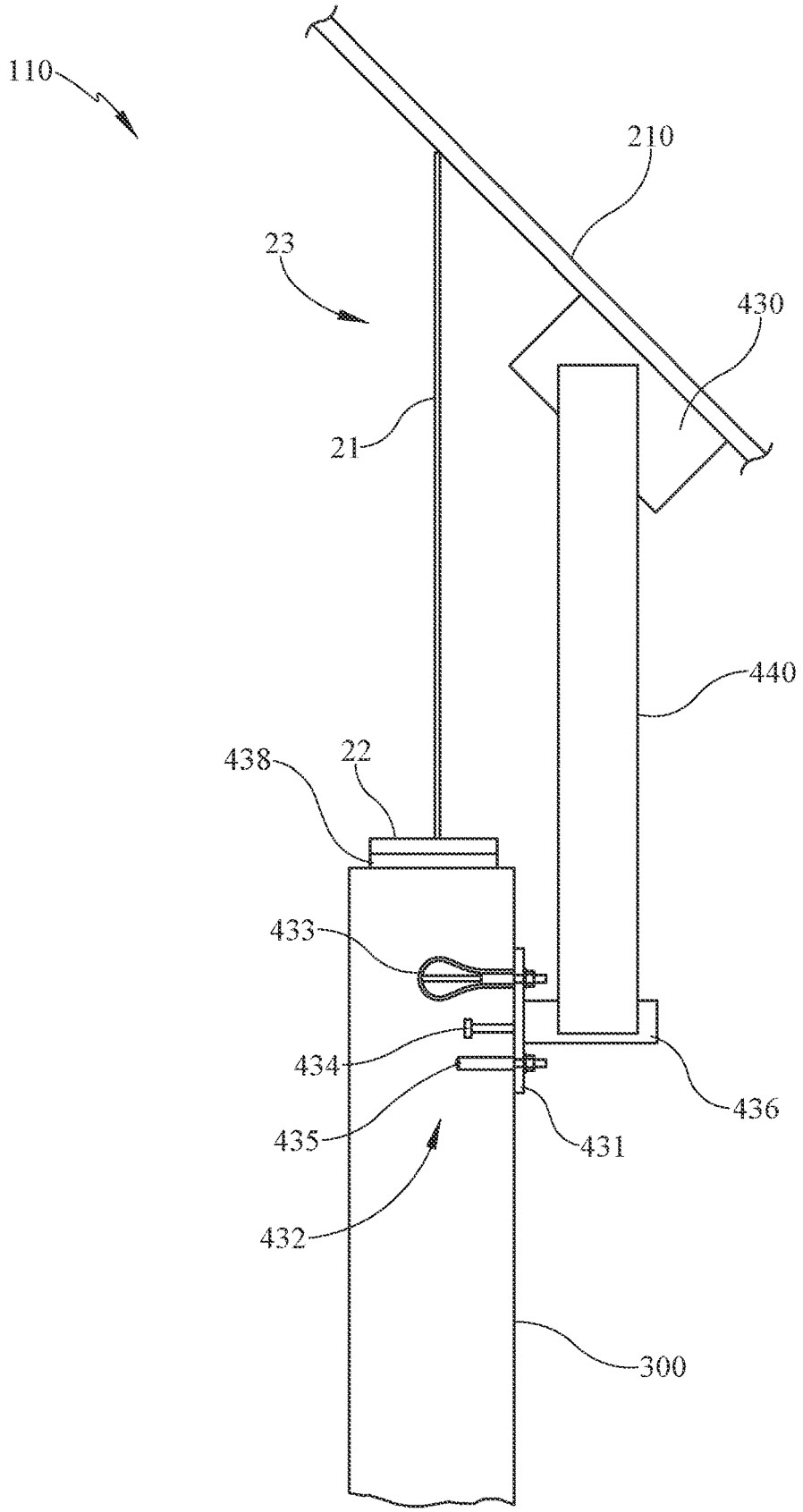
FIG. 16 is an elevation view of an anchorage assembly according to a further alternative embodiment.

FIG. 16 depicts a further alternative embodiment of the anchorage assembly 110. This embodiment is similar to that shown in FIG. 15. Rather than having the anchor chair 430 coupled to the skirt 21, the anchor chair 430 is coupled to the first cone 210. This makes connector 440 longer than that of the embodiment shown in FIG. 15.

As has been described, the various structures described above and shown in the figures, enable a novel and non-obvious method for constructing a composite elevated tank. In general, the primary steps of the construction of such a composite elevated tank involve preparing a foundation 310 for a pedestal 300 at a site pedestal location 11 of water tank site 10. The pedestal 300 is constructed at the site pedestal location 11 by successively placing formwork into which steel reinforcement and wet concrete are placed. The pedestal 300 reaches higher elevations during the construction. Site 10 also can include (but is not mandatory) a temporary tank location 12. Steel tank 200 can (but need not) be built at the temporary tank location 12 concurrently with the construction of the pedestal 300. Temporary tank construction supports 20, on which the steel tank 200 will be constructed for later removal, are prepared at the temporary tank location 12. These steps in the construction method are not limited to the order described here, it being the intent to merely describe an embodiment for ease of description. Base plates 22 are welded to a skirt 21, which is welded to a first cone section 210. Additional cone sections 211 are welded to first cone section 210. For tanks having a suspended bottom 214, the plates making up the suspended bottom are welded to the underside of the first cone section 210. For tanks including an optional access tube 215, the access tube 215 is typically welded to the bottom. Consecutive plates of the tank shell 212 are welded to form the shell of the tank. For tanks having a roof geometry that requires an upper rim angle for support, the upper rim angle 216 is welded to the upper-most plate of tank shell 212. The tank roof 213 is then placed and welded to the upper rim angle 216 to complete the steel tank 200. For certain embodiments, as part of the final pour of the concrete pedestal 300, tank anchor assemblies 311 with anchors 314 are placed at the top of the final formwork. At least one insulator 316 is coupled between or within the bottom surface 313 of the tank anchor assemblies 311 and/or the top surface of the concrete. For certain embodiments using the type of tank anchor assemblies 311 shown in FIGS. 1-10, for example, temporary anchor embedment wing plates 315 are placed at the top of the formwork to ensure proper placement of the tank anchor assemblies 311. After final curing of the top lift of concrete of the pedestal 300, all or a portion of the steel tank 200 is lifted and placed on top of the pedestal 300 such that base plates 22 sit on or couple with the tank anchor assemblies 311. Once proper position and orientation of the steel tank 200 is achieved, base plates 22 are then welded to the tank anchor assemblies 311.

While several embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings is/are used. Those skilled in the art will recognize, or be able to ascertain using no more than routine experimentation, many equivalents to the specific embodiments described herein. It is, therefore, to be understood that the foregoing embodiments are presented by way of example only and that, within the scope of the appended claims and equivalents thereto, embodiments may be practiced otherwise than as specifically described and claimed. Embodiments of the present disclosure are directed to each individual feature, system, article, material, and/or method described herein. In addition, any combination of two or more such features, systems, articles, materials, and/or methods, if such features, systems, articles, materials, and/or methods are not mutually inconsistent, is included within the scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

It is to be understood that the embodiments are not limited in its application to the details of construction and the arrangement of components set forth in the description or illustrated in the drawings. The invention is capable of other embodiments and of being practiced or of being carried out in various ways. Unless limited otherwise, the terms "connected," "coupled," "in communication with," and "mounted," and variations thereof herein are used broadly and encompass direct and indirect connections, couplings, and mountings. In addition, the terms "connected" and "coupled" and variations thereof are not restricted to physical or mechanical connections or couplings.

The foregoing description of several embodiments of the invention has been presented for purposes of illustration. It is not intended to be exhaustive or to limit the invention to the precise steps and/or forms disclosed, and obviously many modifications and variations are possible in light of the above teaching.

What is claimed is:

1. A method of building a composite elevated storage tank comprising steps of:

building a reinforced concrete pedestal on a foundation at a storage tank site;

coupling a tank anchor assembly with a top of said reinforced concrete pedestal;

preparing a temporary tank support;

building a steel tank on said temporary tank support, said steel tank having a first cone section, one or more levels of tank shell side wall, a roof, and a base plate;

lifting said steel tank onto said reinforced concrete pedestal such that said base plate is positioned adjacent said tank anchor assembly; and welding said base plate to said tank anchor assembly.

2. The method of building a composite elevated storage tank of claim 1, wherein said step of building a steel tank further comprises coupling a skirt to said first cone section between said first cone section and said base plate.

3. The method of building a composite elevated storage tank of claim 1, wherein said step of coupling said tank anchor assembly with the top of said reinforced concrete pedestal further comprises separating said tank anchor assembly and said reinforced concrete pedestal with an insulator.

4. The method of building a composite elevated storage tank of claim 3, wherein said tank anchor assembly further comprises an anchor depending from a bottom side of said tank anchor assembly.

5. The method of building a composite elevated storage tank of claim 1, wherein said tank anchor assembly further comprises an anchor depending from a top side of said tank anchor assembly.

6. The method of building a composite elevated storage tank of claim 4, wherein said tank anchor assembly is fastened into said top of said reinforced concrete pedestal before the concrete of said reinforced concrete pedestal has cured.

7. The method of building a composite elevated storage tank of claim 1, wherein said tank anchor assembly further comprises multiple separate plates.

8. The method of building a composite elevated storage tank of claim 1, wherein said tank anchor assembly further comprises a riser.

9. A method of building a composite elevated storage tank comprising steps of:

building a reinforced concrete pedestal on a foundation at a storage tank site;

coupling a tank anchor assembly with a top of said reinforced concrete pedestal, wherein said tank anchor assembly comprises anchor plates with anchor bolts through a side of said reinforced concrete;

preparing a temporary tank support;

building a steel tank on said temporary tank support, said steel tank having a first cone section, one or more levels of tank shell side wall, a roof, and a base plate;

lifting said steel tank onto said reinforced concrete pedestal such that said base plate is positioned adjacent said tank anchor assembly; and coupling said base plate to said tank anchor assembly.

10. A method of building a composite elevated storage tank comprising steps of:

building a reinforced concrete pedestal on a foundation at a storage tank site;

coupling a tank anchor assembly with a top of said reinforced concrete pedestal, wherein said tank anchor assembly comprises an anchor chair supporting an anchor bolt disposed laterally from said reinforced concrete;

preparing a temporary tank support;

building a steel tank on said temporary tank support, said steel tank having a first cone section, one or more levels of tank shell side wall, a roof, and a base plate;

lifting said steel tank onto said reinforced concrete pedestal such that said base plate is positioned adjacent said tank anchor assembly; and coupling said base plate to said tank anchor assembly.

11. A method of building a composite elevated storage tank comprising steps of:

building a reinforced concrete pedestal on a foundation at a storage tank site;

coupling a tank anchor assembly with a top of said reinforced concrete pedestal, wherein said tank anchor assembly spans the full width of the concrete in the reinforced concrete pedestal;

preparing a temporary tank support;

building a steel tank on said temporary tank support, said steel tank having a first cone section, one or more levels of tank shell side wall, a roof, and a base plate;

lifting said steel tank onto said reinforced concrete pedestal such that said base plate is positioned adjacent said tank anchor assembly; and coupling said base plate to said tank anchor assembly.

12. The method of building a composite elevated storage tank of claim 1, wherein said step of lifting said steel tank onto said reinforced concrete pedestal occurs before said steel tank has been fully constructed.

13. The method of building a composite elevated storage tank of claim 1, wherein said step of coupling said tank anchor assembly into the top of said reinforced concrete pedestal further comprises positioning said tank anchor assembly within concrete formwork with temporary anchor embedment wing plates.

14. The method of building a composite elevated storage tank of claim 13, wherein said temporary anchor embedment wing plates further comprise an "L" shaped bracket.

15. The method of building a composite elevated storage tank of claim 1, wherein said temporary tank support is located at said storage tank site.

16. The method of building a composite elevated storage tank of claim 1, wherein the steps of building a reinforced concrete pedestal and building a steel tank on said temporary tank support occur concurrently.

17. A method of building a composite elevated storage tank comprising steps of:

building a reinforced concrete pedestal on a foundation at a storage tank site by beginning with a first section of formwork for said reinforced concrete pedestal and placing steel reinforcement and wet concrete inside the formwork and then repeating to achieve, with additional sections or lifts, an increasing height for said reinforced concrete pedestal until a penultimate level has been achieved;

preparing a temporary tank support;

building a steel tank on said temporary tank support by fabricating an assembly comprising a first cone section, a skirt welded to a bottom of said first cone section, and a base plate welded to a bottom of said skirt;

placing said assembly on said temporary tank support by setting said base plate on said temporary tank support;

continuing to build said steel tank from the bottom upwards by welding additional cone sections above said first cone section until a desired number of additional cone sections has been achieved;

welding plates of a first level of tank shell to a top level of an uppermost cone section of said additional cone sections;

continuing to add levels to said tank shell by welding plates of additional levels to each successive lower level until a desired height of said tank shell has been achieved;

in an ultimate lift of the reinforced concrete pedestal, placing a tank anchor assembly at the top of the formwork;

lifting said steel tank onto said reinforced concrete pedestal such that said base plate is positioned adjacent said tank anchor assembly; and coupling said base plate to said tank anchor assembly.

18. The method of building a composite elevated storage tank of claim 17, wherein said step of placing said tank anchor assembly at the top of the formwork further comprises placing an insulator separating said tank anchor assembly from said reinforced concrete pedestal.

19. The method of building a composite elevated storage tank of claim 18, wherein said tank anchor assembly further comprises an anchor depending from a bottom side of said tank anchor assembly.

20. The method of building a composite elevated storage tank of claim 19, wherein said tank anchor assembly spans the full width of the concrete of the reinforced concrete pedestal.

21. The method of building a composite elevated storage tank of claim 17, wherein the step of lifting said steel tank onto said reinforced concrete pedestal is performed before said steel tank has been fully constructed.

22. The method of building a composite elevated storage tank of claim 17, wherein said temporary tank support is located at the storage tank site.

23. A method of building a composite elevated storage tank comprising the steps of:

building a foundation at a storage tank site;

building a temporary tank support near said foundation and at said storage tank site;

building a reinforced concrete pedestal on said foundation;

fastening a tank anchor assembly onto said reinforced concrete pedestal;

building a steel tank on said temporary tank support, said steel tank having a first cone section, one or more levels of tank shell side wall, and a roof, wherein said first cone section further comprises a skirt depending therefrom, and said skirt further comprises a base plate welded to a bottom of said skirt;

lifting said steel tank onto said reinforced concrete pedestal such that said base plate sits on said tank anchor assembly; and welding said base plate to said tank anchor assembly.

24. The method of building a composite elevated storage tank of claim 23, wherein said step of building a reinforced concrete pedestal and the step of building a steel tank occur concurrently.

25. The method of building a composite elevated storage tank of claim 23, wherein said step of fastening a tank anchor assembly onto said reinforced concrete pedestal further comprises positioning said tank anchor assembly using temporary anchor embedment wing plates.

* * * * *